US006056290A

United States Patent [19]

Holloway

[11] Patent Number: 6,056,290

[45] Date of Patent: May 2, 2000

[54] NOVELTY GAME CUBE

[76] Inventor: James R. Holloway, 1627 Monet Cove, Fort Wayne, Ind. 46845

[21] Appl. No.: 09/056,302

[22] Filed: Apr. 7, 1998

[51] Int. Cl.[7] ..... A63F 9/08

[52] U.S. Cl. ..... 273/153 S

[58] Field of Search ..... 273/153 S, 156, 273/155, 153 R

[56] References Cited

U.S. PATENT DOCUMENTS

| | | | |
|---|---|---|---|
| 4,474,377 | 10/1984 | Ashley | 273/153 S |
| 5,823,530 | 10/1998 | Yang | 273/153 S |

FOREIGN PATENT DOCUMENTS

| | | | |
|---|---|---|---|
| 3247097 | 5/1984 | Germany | 273/153 S |
| 1258456 | 9/1986 | U.S.S.R. | 273/153 S |
| 1284577 | 1/1987 | U.S.S.R. | 273/153 S |
| 1405867 | 6/1988 | U.S.S.R. | 273/153 S |

*Primary Examiner*—Steven Wong

[57] ABSTRACT

The present invention relates to a novelty game cube. The game cube of the present invention is comprised of twelve different side edge pieces. Each of these side edge pieces, in turn, includes two triangular exterior faces of different colors. The triangluar exterior faces of the side edge pieces together form the six sides of the game cube. Cube elements are formed through the interconnection of three ajoining side edge pieces. These cube elements are rotatably connected to the interior of the game cube. All together there are eight cube elements. The object of the game is to rotate the cube elements to form a cube with six faces of a uniform color.

1 Claim, 3 Drawing Sheets

NOVELTY GAME CUBE

BACKGROUND OF THE INVENTION

1. Field of the Invention

The present invention relates to a novelty game cube and more particularly pertains to such a cube which employs twelve different edge pieces.

2. Description of the Prior Art

The use of a polyhedron puzzles is known in the prior art. More specifically, such polyhedron puzzles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,706,956 to Abu-Shummays discloses a regular polyhedron puzzle. U.S. Pat. No. 4,674,750 also to Abu-Shummays discloses a dodecahedron class cubic puzzle. U.S. Pat. No. 4,474,376 to Gustafson discloses a manipulable isocahedron toy. U.S. Patent 4,586,713 to Abu-Shumays discloses a star prism puzzle. U.S. Pat. No. 4,593,907 to Abu-Shumays discloses a polyhedral and spherical cubic puzzle. Lastly, U.S. Design Pat. No. 264,361 to Meffert discloses the design of a puzzle toy.

In this respect, the game cube of the present invention substantially departs from the conventional concepts and designs of the prior art, and in so doing provides an apparatus primarily developed for the purpose of providing a game cube with easily movable components.

Therefore, it can be appreciated that there exists a continuing need for improvements in the novelty game arts. In this regard, the present invention substantially fulfills this need.

SUMMARY OF THE INVENTION

In view of the foregoing disadvantages inherent in the known types of polyhedron puzzles now present in the prior art, the present invention provides a game cube with eight different rotatable cube elements. As such, the general purpose of the present invention, which will be described subsequently in greater detail, is to create a game with an appropriate level of difficultly.

To attain this, the present invention essentially comprises a novelty game cube. The game cube of the present invention is comprised of twelve different side edge pieces. Each of these side edge pieces, in turn, includes two triangular exterior faces of different colors. The triangular exterior faces of the side edge pieces together form the six sides of the game cube. Cube elements are formed through the interconnection of three adjoining side edge pieces. These cube elements are rotatably connected to the interior of the game cube. All together there are eight cube elements. The object of the game is to rotate the cube elements to form a cube with six faces of a uniform color.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved game cube with six faces. The game cube comprises a central octahedron having eight equally dimensioned faces. An aperture is centrally formed within each of the faces. The cube also includes eight tetrahedrons. Each of these tetrahedrons has four equally dimensioned faces with one of the faces being a base, and three of the faces being exterior faces. Each base is defined by three adjoining edges. Each base edge includes a track with an upstanding edge formed within each of the base edges. Each base further includes an orthogonal axle extending therefrom. Each of the orthogonal axles are rotatably secured within one of the apertures of the octahedron. Each of the tetrahedrons has a hollow interior. The cube also includes twelve edge pieces. Each of these edge pieces has two exterior faces and two base faces. The two base faces are joined at a central edge. An aperture with diametrically opposed slots is formed within the central edge,and each edge piece contacts two of the tetrahedrons. Specifically, the base faces of each edge piece are in contact with exterior faces of two adjacent tetrahedrons with the upstanding edges of the opposing tetrahedrons being slidably positioned within the aperture of the edge piece. Each tetrahedron thus contacts three different edge pieces such that rotation of one of the tetrahedrons results in the rotation of the three contacting side edge pieces. Each tetrahedron and three associated side edges constitute an element of the game cube. Each of the exterior faces of each side edge are of two distinct colors, and four of the side edges have an exterior face of the same color such that the elements of the game cube can be rotated such that each of the cube faces is of a single color.

It is another object of the present invention to provide a game cube with hollow component parts for creating a lightweight and sturdy game cube.

It is a further object of the present invention to provide a game cube which incorporates six different distinctive colors.

An even further object of the present invention is to provide a game cube which is susceptible of a low cost of manufacture with regard to both materials and labor, and which accordingly is then susceptible of low prices of sale to the consuming public, thereby making such game cubes economically available to the buying public.

Still another object of the present invention is to provide a game cube with twelve different edge pieces which can be rotated via eight different tetrahedron pieces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
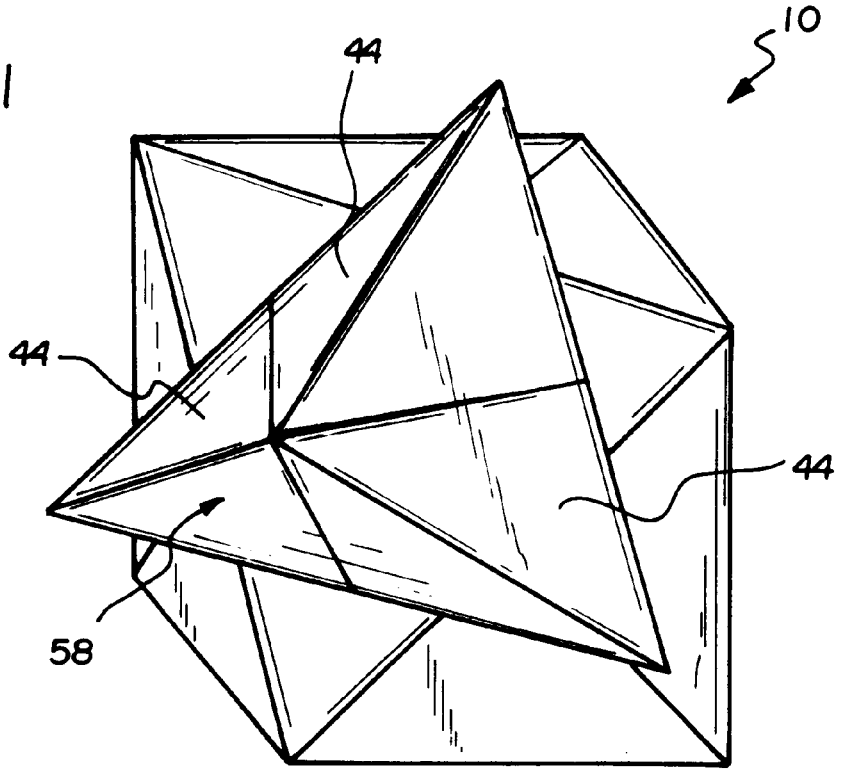
FIG. 1 is a view of the game cube with one of the elements being rotated.
Figure 2:
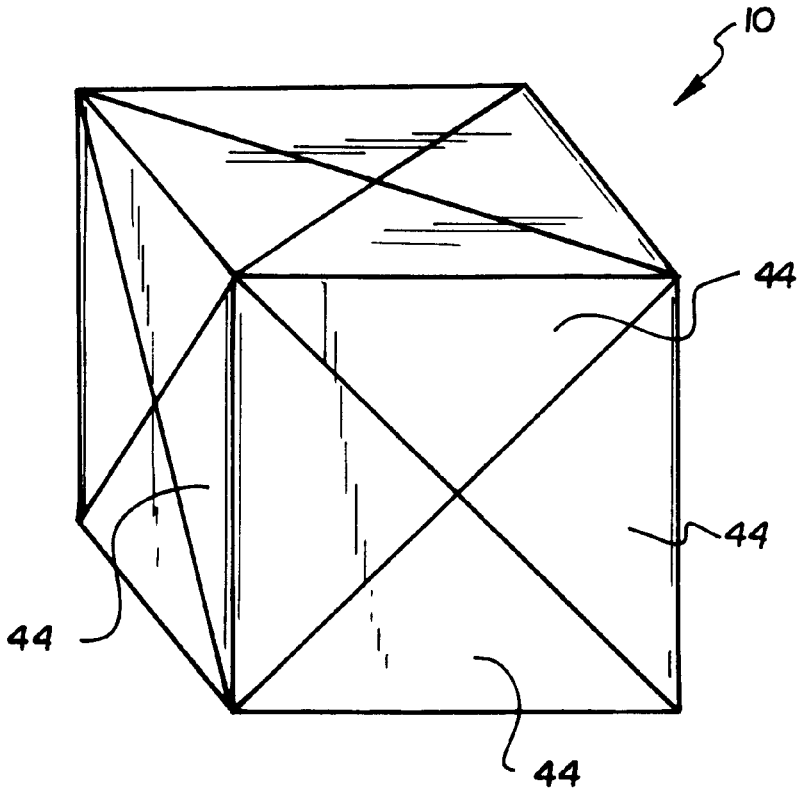
FIG. 2 is a view of the game cube.

With reference now to the drawings, and in particular to FIG. 1 thereof, the game cube of the present invention is depicted. The cube faces are comprised of twelve different side edge pieces. Each of these side edge pieces, in turn, includes two triangular exterior faces of different colors. The triangular exterior faces of the side edge pieces together form the six sides of the game cube. Cube elements are formed through the interconnection of three adjoining side edge pieces. These cube elements are rotatably connected to the interior of the game cube. All together there are eight cube elements. The object of the game is to rotate the cube elements to form a cube with six faces, each of a uniform color. The various components of the present invention, and the manner in which they interrelate, will be described in greater detail hereinafter.

Figure 3:
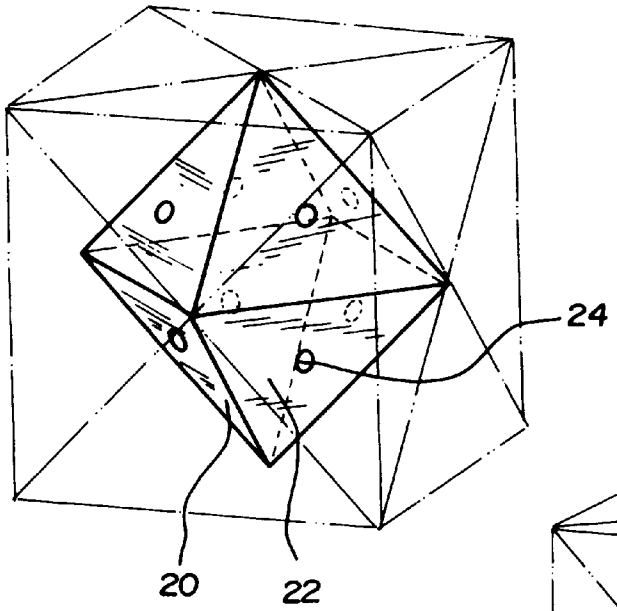
FIG. 3 is a view of the central octahedron.

The main framework of the game cube 10 is a central octahedron 20. This octahedron 20 is illustrated with reference to FIG. 3. The octahedron 20 is defined by eight equally dimensioned faces 22. Additionally, an aperture 24 is centrally formed within each of the faces. The function of these apertures will be described in greater detail hereinafter.

Figure 4:
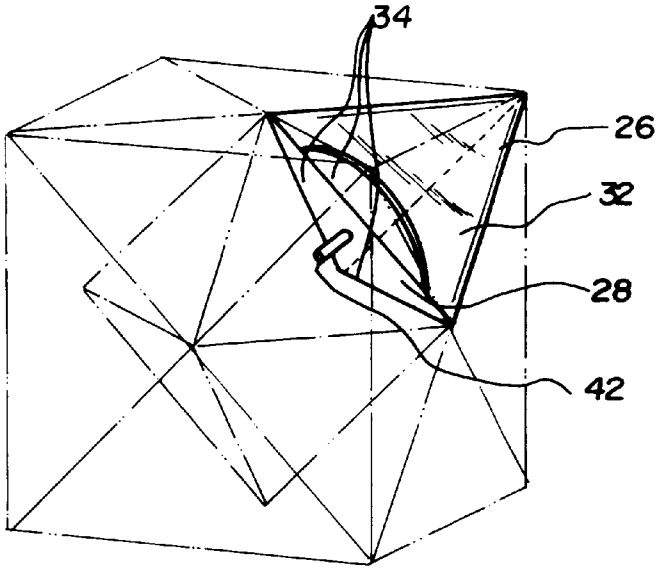
FIG. 4 is a view of one of the tetrahedrons, with the other tetrahedrons being removed for clarity.
Figure 6:
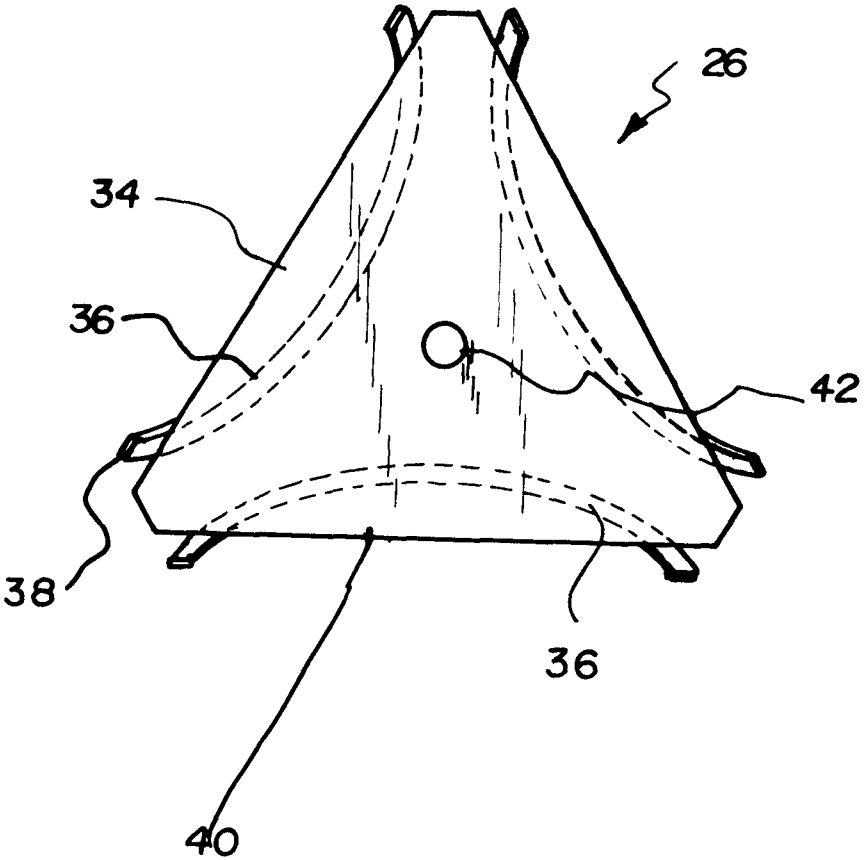
FIG. 6 is a plan view of one tetrahedron.

There are eight tetrahedrons 26 which are then interconnected to the faces 22 of the octahedron 20. One such tetrahedron 26 is illustrated with reference to FIG. 4. The other tetrahedrons 26 have been left off for purposes of clarity, but they are of an identical construction. Specifically, each of the tetrahedrons 26 is defined by four equally dimensioned faces. One of these faces constitutes the base 28 of the tetrahedron 26, while the remaining three faces 32 comprise the exterior faces. Each tetrahedron base 28 is further defined by three adjoining edges 34, note FIG. 4. Each base edge 34, in turn, includes an arcuate aperture and an extending track 36. With reference to FIG. 6, the three extending tracks 36 of one such tetrahedron 26 is depicted. Additionally, each track 36 is further defined by an upstanding edge 38 which is formed within each of the base edges 34. The function of these tracks 36 and base edges 34 will be described in greater detail hereinafter. The base 28 of each tetrahedron 26 includes an orthogonal axle 42 extending therefrom. With reference to FIG. 4, each of the orthogonal axles 42 is rotatably secured within one of the apertures 24 of the octahedron 20. In this manner each tetrahedron 26 is capable of 360 degrees of rotation. In the preferred embodiment each of the tetrahedrons 26 is constructed from a impact resistant plastic. Additionally, each tetrahedron 26 is formed with a hollow interior.

Figure 5:
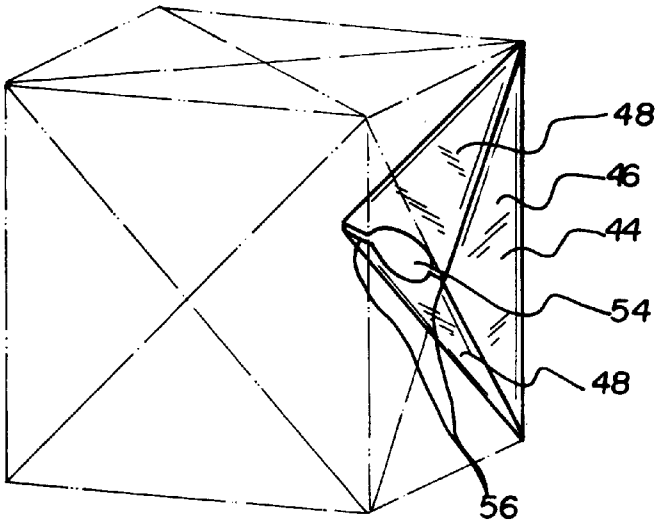
FIG. 5 is a view of the side edge piece, with the other side edge pieces being removed for clarity.
Figure 7:
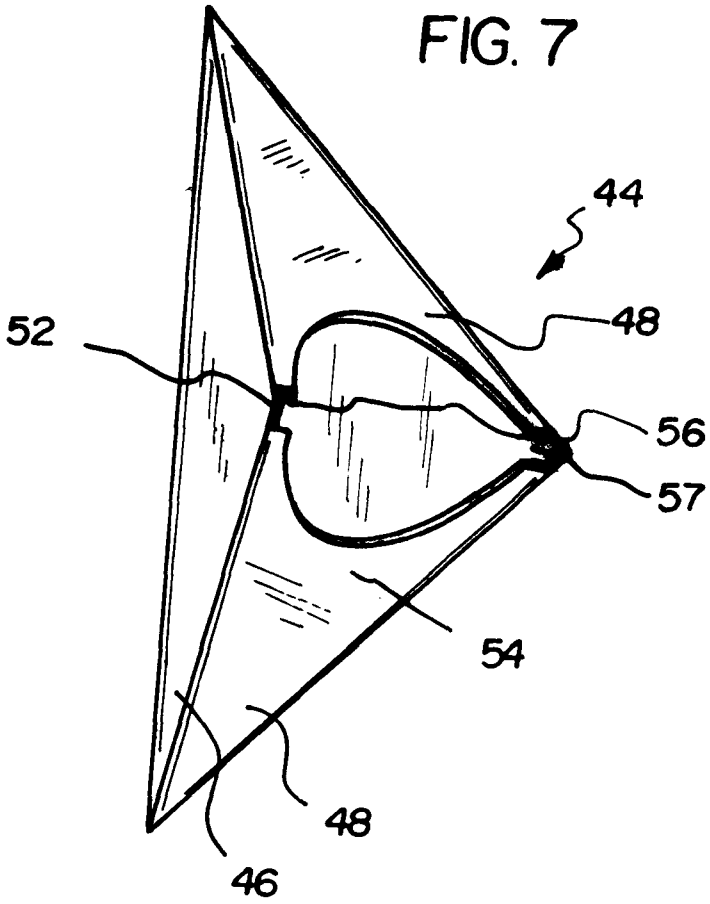
FIG. 7 is a perspective view of one of the side edge pieces.

The game cube 10 of the present invention also includes twelve edge pieces 44. In the preferred embodiment each edge piece 44 is of identical construction and is hollow. Each of these edge pieces 44 are defined by two exterior faces 46 and two base faces 48. One such edge piece 44 is illustrated in FIG. 7. The two base faces 48 of the edge piece 44 join together at a central edge 52. An aperture 54 with diametrically opposed slots 56 and 57 is formed within this central edge 52. Each of the edge pieces 44 is oriented such that it contacts two of the tetrahedrons 26. More specifically, the base faces 48 of each edge piece 44 are in contact with exterior faces 32 of two adjacent tetrahedrons 26. To maintain this configuration, the upstanding edges 38 of the opposing tetrahedrons 26 are slidably positioned within the aperture 54 and slots 56 and 57 of the edge piece 44. Upon rotation of one of the tetrahedrons 26 its upstanding edge 38 is locked into the aperture 54 of the corresponding side edge 34. In this manner the tetrahedron 26 and side edge 44 rotate together. At the same time the upstanding edge 38 of the opposing tetrahedron 26 slides free of the aperture 54 of the side edge. In this manner, any individual side edge piece 44 can be rotated by one of two tetrahedrons 26. FIG. 5, illustrates the orientation of one edge piece 44 in relation to the game cube 10, the other eleven edge pieces have been removed for purposes of clarity. Each exterior face of each tetrahedron 26 thus contacts three different edge pieces 44. In this manner, rotation of one of the tetrahedrons 26 results in the rotation of the three contacting side edge pieces 44. Each tetrahedron 26 with its three associated side edge pieces 44 together constitute an element 58 of the game cube. There are a total of eight such elements.

When the cube is solved, each of the faces of the game cube is of a solid color. Thus, there are a total of six different colors incorporated into the cube. Additionally, the two exterior faces of each side edge are of two different colors. Four of the side edges have an exterior face of the same color, such that the elements of the game cube can be rotated such that each of the cube faces is of a single color.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game cube with six faces, the game cube comprising, in combination:

a central octahedron having eight equally dimensioned faces, an aperture centrally formed within each of the faces;

eight hollow tetrahedrons, each of the tetrahedrons having four equally dimensioned faces with one of the faces being a base, and three of the faces being exterior faces, each base being defined by three adjoining edges, a track with an upstanding edge formed within each of the base edges and extending beyond the base edges at its opposite ends, each base including an orthogonal axle extending therefrom, each of the orthogonal axles being rotatably secured within one of the apertures of the octahedron, each of the tetrahedrons having a hollow interior;

twelve hollow edge pieces, each of the edge pieces having two exterior faces and two base faces, the two base faces being joined at a central edge, an aperture with diametrically opposed slots formed within the central edge, each edge piece contacting two of the tetrahedrons, specifically the base faces of each edge piece are in contact with exterior faces of two adjacent tetrahedrons with the upstanding edges of the opposing tetrahedrons being positioned within the aperture of the edge piece, each tetrahedron thus contacting three different edge pieces such that rotation of one of the tetrahedrons results in the rotation of the three contacting side edge pieces, each tetrahedron and three associated side edges constituting an element of the game cube, each of the exterior faces of each side edge being of two distinct colors, four of the side edges having an exterior face of the same color such that the elements of the game cube can be rotated such that each of the cube faces is of a single color.

* * * * *